US008987515B2

(12) United States Patent
Rowland

(10) Patent No.: US 8,987,515 B2
(45) Date of Patent: Mar. 24, 2015

(54) CROSS PRODUCTS AND CO-OLIGOMERS OF PHENYLENEDIAMINES AND AROMATIC AMINES AS ANTIOXIDANTS FOR LUBRICANTS

(71) Applicant: Chemtura Corporation, Middlebury, CT (US)

(72) Inventor: Robert G. Rowland, Woodbridge, CT (US)

(73) Assignee: Chemtura Corporation, Middlebury, CT (US)

( * ) Notice: Subject to any disclaimer, the term of this patent is extended or adjusted under 35 U.S.C. 154(b) by 0 days.

(21) Appl. No.: 13/681,849

(22) Filed: Nov. 20, 2012

(65) Prior Publication Data

US 2013/0150275 A1 Jun. 13, 2013

Related U.S. Application Data

(60) Provisional application No. 61/569,902, filed on Dec. 13, 2011.

(51) Int. Cl.

| | |
|---|---|
| ***C07C 211/00*** | (2006.01) |
| ***C10M 133/12*** | (2006.01) |
| ***C10M 159/12*** | (2006.01) |
| ***C10M 169/04*** | (2006.01) |

(52) U.S. Cl.

CPC ..... *C10M 133/12* (2013.01); *C10M 159/12* (2013.01); *C10M 169/04* (2013.01); *C10M 2207/2835* (2013.01); *C10M 2215/06* (2013.01); *C10M 2215/064* (2013.01); *C10N 2230/10* (2013.01); *C10N 2270/02* (2013.01)

USPC ..... 564/305; 508/557

(58) Field of Classification Search

None

See application file for complete search history.

(56) References Cited

U.S. PATENT DOCUMENTS

| | | | | |
|---|---|---|---|---|
| 2,451,642 | A | | 10/1948 | Watson |
| 2,718,501 | A | | 9/1955 | Harle |
| 2,857,424 | A | | 10/1958 | Cox |
| 2,883,362 | A | | 4/1959 | Rosenwald et al. |
| 3,211,793 | A | | 10/1965 | Roos et al. |
| 3,304,285 | A | | 2/1967 | Cox |
| 3,402,201 | A | | 9/1968 | Schmerling |
| 3,509,214 | A | | 4/1970 | Braid et al. |
| 3,573,206 | A | | 3/1971 | Braid et al. |
| 3,901,815 | A | | 8/1975 | Reale |
| 4,064,059 | A | | 12/1977 | Nebzydoski et al. |
| 4,110,234 | A | | 8/1978 | Loveless et al. |
| 4,122,021 | A | | 10/1978 | Loveless et al. |
| 4,737,159 | A | * | 4/1988 | Phillips ..... 44/334 |
| 4,770,802 | A | | 9/1988 | Ishida et al. |
| 5,160,647 | A | | 11/1992 | Odorisio et al. |
| 5,207,939 | A | | 5/1993 | Farng et al. |
| 5,232,614 | A | | 8/1993 | Colclough et al. |
| 5,711,767 | A | | 1/1998 | Gande et al. |
| 6,426,324 | B1 | | 7/2002 | Lai et al. |
| 7,307,049 | B1 | | 12/2007 | DiBella |
| 2006/0128574 | A1 | | 6/2006 | Dong et al. |
| 2006/0189824 | A1 | | 8/2006 | Kumar et al. |
| 2007/0006855 | A1 | | 1/2007 | Malandro et al. |

FOREIGN PATENT DOCUMENTS

| | | | | |
|---|---|---|---|---|
| EP | 2055763 | A1 | 5/2009 | |
| GB | 1 296 592 | | 11/1972 | |
| GB | 2384245 | A | 7/2003 | |
| WO | WO9516765 | * | 6/1995 | ..... C10M 133/12 |
| WO | WO 95/16765 | | 3/2008 | |

* cited by examiner

*Primary Examiner* — Clinton Brooks

(57) ABSTRACT

Radical initiated reactions of phenylenediamines with alkylated aromatic amines produce an antioxidant mixture containing cross reaction products of the phenylenediamines and alkylated aromatic amines which are useful, for example, as antioxidants, stabilizers, and antiozonants for lubricants, electronic chemicals, rubbers, urethanes and other polymer resins, crop protection, pharmaceuticals, dyes and toners.

9 Claims, No Drawings

CROSS PRODUCTS AND CO-OLIGOMERS OF PHENYLENEDIAMINES AND AROMATIC AMINES AS ANTIOXIDANTS FOR LUBRICANTS

This application claims benefit under 35 USC 119(e) of U.S. Provisional Application No. 61/569,902, filed Dec. 13, 2011, the disclosure of which is incorporated herein by reference.

The present invention relates to aromatic polyamines comprising the cross reaction products of phenylenediamines and alkylated aromatic amines, and methods for producing the same. Such aromatic polyamines may be used, for example, as antioxidants, stabilizers, and antiozonants for lubricants, electronic chemicals, rubbers, urethanes and other polymer resins, crop protection, pharmaceuticals, dyes and toners.

BACKGROUND OF THE INVENTION

Lubricants, such as those used in a variety of machinery, are susceptible to oxidative deterioration during storage, transportation, and usage, particularly when such lubricants are exposed to high temperatures and iron catalytic environments, which greatly promote their oxidation. This oxidation, if not controlled, contributes to the formation of corrosive acidic products, sludge, varnishes, resins, and other oil-insoluble products and may lead to a loss of physical and tribological properties of the lubricants. Oxidation of aviation lubricants, such as synthetic polyol esters, is particularly undesirable, given the potential consequences of in-flight engine failure. It is therefore a common practice to include antioxidant additives in lubricants to prevent, at least to some extent, oxidation, so as to extend the useful life of the lubricants.

Alkylated diphenylamines are widely known in the art as antioxidants. Commercial applications include lubricants, rubber, plastics, polyurethanes, hydraulic fluids, greases and fuels.

The use of 1,4-benzenediamines is also known, as exemplified in U.S. Pat. Nos. 2,718,501, 2,883,362, 3,211,793, 3,304,285, and 5,711,767, U.S. Publication Nos. 2006/0128574, 2006/0189824, and 2007/0006855, GB1296592, and GB0835826 and JP59020392, the disclosures of which US patents and applications are incorporated herein by reference. 1,4-benzenediamines have more commonly been employed as motor fuel stabilizers and antiozonants and antioxidants for rubber.

U.S. Pat. No. 2,451,642 discloses meta-phenylenediamine, $N^1$,$N^3$-dimethyl-meta-phenylenediamine, and lauryl-meta-phenylenediamine as useful antioxidants for lubricating oil compositions in environments where iron-catalyzed oxidation reaction can take place. N,N'-dimethyl-ortho-phenylenediamine, N,N'-dicyclohexyl-para-phenylenediamine, and various di- and tetra-n-alkyl-para-phenylenediamines are similarly disclosed.

U.S. Pat. No. 2,718,501 discloses a stabilizer system consisting of an aromatic amine with at least two aromatic rings, including N,N'-diphenyl-para-phenylenediamine, and an organic aliphatic sulfur compound, which is said to be suitable for stabilizing mineral hydrocarbon lubricating oils, synthetic hydrocarbon oils, and polyalkylene glycol oils.

U.S. Pat. No. 2,857,424 discloses the preparation of oxalic acid salts of fuel stabilizing N,N'-dialkyl-para-phenylenediamines as a way of rendering the additives less toxic.

U.S. Pat. No. 3,402,201 discloses N,N'-dicyclooctyl-p-phenylenediamine as a stabilizer for organic materials, particularly rubber, and exemplifies its use as a gasoline inhibitor. The similar use of N,N'-dicyclooctyl-o- and m-phenylenediamines is contemplated.

U.S. Pat. Nos. 5,207,939 and 5,312,461 disclose certain Mannich base reaction products of mono- or dialkyl-phenylenediamines, an aldehyde or ketone, and a hindered phenol, which can be used in an antioxidant amount in lubricating oils, greases, and fuel compositions.

U.S. Publication No. 2006/0128574 discloses the use of physical mixtures of secondary diarylamines in combination with N,N'-dialkyl-para-phenylenediamines, and optionally hindered phenolics, as stabilizers for lubricants and fuels, but is silent regarding improvements in performance that may be achieved by reaction products thereof.

U.S. Publication No. 2006/0189824 discloses various N-alkyl-N-(dialkylhydroxyphenyl)alkyl-N'-phenyl-para-phenylene diamines, methods for their preparation by Mannich reactions of dialkylphenols with N-phenyl-para-phenylenediamines, and their use as antioxidants.

U.S. Publication No. 2007/0006855 discloses the use of alkylated para-phenylenediamines as soot dispersants in passenger car and heavy-duty diesel engines equipped with exhaust gas recirculation systems. An extremely broad scope of polyalkylated para-phenylenediamines is disclosed for this specific application alone.

Japan Patent No. 59-020,392 discloses a lubricant composition comprising N, N'-di-sec-butyl-para-phenylenediamine for pressure forming of oil tanks. The lubricant composition also contains hindered phenolic antioxidant.

Oberster, A. E. et al., 45 CAN. J. CHEM. 195-201 (1967), prepared 39 novel phenylenediamines as part of a program to find antiozonants for rubber that are not sensitizers or dermatotoxic. In some compounds the N'-phenylenediamine nitrogen was variously fused into a pyrrolidine, piperidine, hexamethyleneimine (homopiperidine), morpholine, or 2,6-dimethylmorpholine ring.

Makogon, A. N. et al., 12 KHEMICHESKAYA PROMYSHLENNOST, SERIYA: METODY ANALIZA I KONTROLYA KACHESTVA PRODUKTSII V KHIMICHESKOI PROMYSHLENNOSTI 18-21 (1980), describe the characterization of N, N'-dialkyl-para-phenylenediamines reaction products obtained by the catalytic alkylation of 4-aminodiphenylamine with $C_7$-$C_9$ alcohols.

While phenylenediamines are known to act effectively as antioxidants, the presence of these compounds in amounts conventionally used to provide antioxidancy displayed aggressiveness toward fluoroelastomeric engine seal materials. These adverse effects are particularly apparent with phenylenediamine compounds having higher nitrogen contents (compounds having relatively small hydrocarbyl substituents).

U.S. Pat. Nos. 3,509,214 and 3,573,206 describe the use of inorganic oxidants, such as potassium permanganate, lead dioxide, manganese dioxide, and hydrogen peroxide to prepare an oligomeric mixture between a phenyl naphthylamine and an alkylated diphenylamine. However potassium permanganate or manganese dioxide form very fine precipitates that readily clog filter apparatus. Lead dioxide is to be avoided for obvious environmental reasons.

U.S. Pat. Nos. 3,901,815 and 4,064,059 disclose compositions of alkylated phenylnaphthyl-amines and alkylated diarylamines as antioxidants for pentaerythritol and trimethylolpropane ester aviation turbine lubricants.

U.S. Pat. No. 4,110,234 describes the stabilization of a poly alpha olefin oil with an antioxidant comprising an alkylated phenyl naphthylamine, a sulfur compound, and a trace amount of a metal, such as copper or nickel. U.S. Pat. No. 4,122,021 describes the stabilization of any of a poly alpha olefin, a highly saturated mineral oil, or and ester oil with an antioxidant comprising an alkylated phenyl naphthylamine and a sulfoxide. U.S. Pat. No. 4,770,802 claims phenyl napthylamines that are substituted with a branched chain of 12 to 15 carbons.

U.S. Pat. No. 5,160,647 teaches the Mannich dimer product 4,4'-methylenebis[N-(4-tert-octylphenyl)-1-naphthylamine] as an antioxidant for aircraft turbine lubricants.

U.S. Pat. No. 6,426,324 describes the use of an organic peroxide radical source to prepare an oligomeric mixture between two diarylamines, e.g., a phenyl naphthylamine and an alkylated diphenylamine. The mole ratio of diphenylamine to phenyl naphthylamine is between 1:1 and 10:1. The patent does not contemplate the use of an organic peroxide radical source to prepare an oligomeric mixture between a phenyl naphthylamine and a substituted phenylenediamine.

U.S. Pat. No. 7,307,049 discloses reaction products of alkylated phenyl naphthylamines and formaldehyde as antioxidants for synthetic polyol ester lubricating oils.

EP 606,863 A3 discloses alkylated phenyl naphthylamines as antioxidants for oxyalkylene glycols and their mono- and dialkyl ethers.

EP 2,055,763 A1 describes the use of an alkylated phenyl naphthylamine in combination with two different alkylated diphenylamines as antioxidants, at least one of which has a number average molecular weight of from 321 to 700. The arylamine antioxidants in question are all well known commercially available materials which do not contain additional arylamine substituents or condensates.

The foregoing US disclosures are incorporated by reference.

SUMMARY OF THE INVENTION

It has been found that the products obtained by the organic radical initiated reaction between members of a mixture of phenylenediamines and diarylamines provide an antioxidant that is superior to the parent amines, or mixtures of the parent amines, as stabilizers for oxidative deposit control in lubricants, such as polyol ester lubricants. Excellent results are obtained, for example, when evaluated by a Panel-Coker test. The antioxidant of the invention comprises phenylenediamine/diarylamine cross products, that is products formed by the incorporation of at least one phenylenediamine and at least one diarylamine into a single compound. Often, the cross products are co-oligmers containing repeating units derived from each of the reactants. Typically mixtures are formed comprising more than one cross product and often further comprise phenylenediamine or diarylamine homo-oligomers, i.e., dimers and trimers etc of the phenylenediamine or diarylamine, however, mixtures of only homo-oligomers of the parent amines are shown to be less effective than the antioxidant mixtures comprising the present cross products.

The antioxidant can be prepared as a concentrate in a carrier, such as a lubricant, for example a polyol ester lubricant. The polyol ester of the concentrate may be the same or different as the fluid to be stabilized, so long as the former is sufficiently soluble in the latter. In some embodiments the antioxidant is prepared in the presence of the carrier and cross products comprising phenylenediamine, diarylamine and carrier, e.g., polyol ester, are also formed as a component of the antioxidant.

DESCRIPTION OF THE INVENTION

Novel antioxidants are prepared by radical induced reaction between a phenylenediamine and a diaryl amine. Radical initiators that can be used in the reaction include organic peroxides and diazo compounds. In light of the potential safety issues involved with the use of diazo compounds, the novel antioxidants are typically prepared using an organic peroxide as initiator.

The antioxidants of the invention are typically mixtures comprising cross products of the phenylenediamine and a diaryl amine reactants and in some embodiments also comprise cross products of the phenylenediamine, diaryl amine, and a non-amine component such as a component derived from a carrier or solvent in which the radical induced reaction is run. Thus, the inventive antioxidant is best described as product by process obtained by reacting a) at least one phenylene diamine with b) at least one diaryl amine in the presence of an initiator selected from organic peroxides and organic diazo compounds, and optionally in the presence of a liquid hydrocarbon or polyol ester.

The at least one phenylenediamine is, for example, selected from compounds of structure I,

I

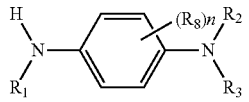

wherein $R_1$ is selected from the group consisting of $C_{1-12}$ alkyl, $C_{6-14}$ aryl, $C_{6-14}$ aryl substituted by one or more $C_{1-12}$ alkyl groups, and $C_{7-18}$ aralkyl;

$R_2$ and $R_3$ are independently selected from the group consisting of H, $C_{1-12}$ alkyl, $C_{6-14}$ aryl, $C_{6-14}$ aryl substituted by one or more $C_{1-12}$ alkyl groups, and $C_{7-18}$ aralkyl;

n is 0, 1 or 2 and $R_8$ is $C_{1-12}$ alkyl, wherein when n is 2, each $R_8$ may be the same or different.

In many embodiments the phenylenediamine is selected from compounds of structure I wherein n is 0, for example, compounds according to

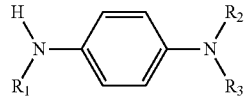

wherein $R_1$ is selected from the group consisting of $C_{1-12}$ alkyl, $C_{7-18}$ aralkyl, phenyl, phenyl substituted by one or more $C_{1-12}$ alkyl groups, naphthyl and naphthyl substituted by one or more $C_{1-12}$ alkyl groups;

$R_2$ is selected from the group consisting of $C_{1-12}$ alkyl, $C_{7-18}$ aralkyl, phenyl, phenyl substituted by one or more $C_{1-12}$ alkyl groups, naphthyl and naphthyl substituted by one or more $C_{1-12}$ alkyl groups;

$R_3$ is selected from the group consisting of H, $C_{1-12}$ alkyl, $C_{7-18}$ aralkyl, phenyl, phenyl substituted by one or more $C_{1-12}$ alkyl groups, naphthyl and naphthyl substituted by one or more $C_{1-12}$ alkyl groups;

and often, $R_1$ and $R_2$ are each selected from the group consisting of $C_{3-12}$ alkyl; for example $R_1$ and $R_2$ are each selected from the group consisting of $C_{4-8}$ alkyl.

The at least one diaryl amine is, for example, selected from compounds of structure II

II

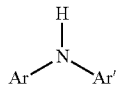

wherein Ar and Ar' are independently $C_{6-14}$ aryl groups which aryl groups are unsubstituted or substituted by one or more substituent selected from the group consisting of $C_{1-12}$ alkyl, $C_{6-10}$ aryl, $C_{7-18}$ aralkyl and $C_{7-18}$ alkylated aryl, wherein when said $C_{1-12}$ alkyl contains 4 or more carbon atoms it can from a ring fused to said $C_{6-14}$ aryl group;

for example, Ar and Ar' are independently phenyl or naphthyl, which phenyl or naphthyl are unsubstituted or substituted by one or more substituent selected from the group consisting of $C_{1-12}$alkyl, $C_{6-14}$ aryl, $C_{6-14}$ aryl substituted by one or more $C_{1-12}$ alkyl groups, and $C_{7-18}$ aralkyl.

In many embodiments the at least one diaryl amine of formula II is selected from the group consisting of compounds according to

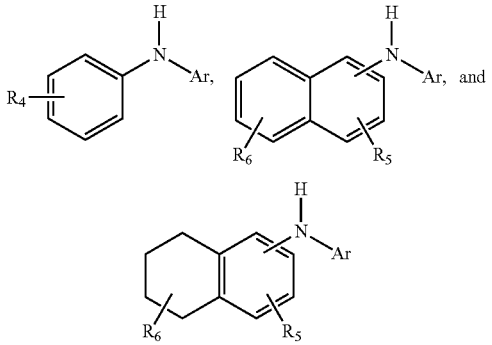

wherein Ar is selected from the group

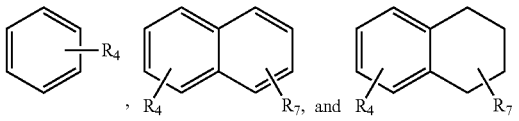

wherein each $R_4$, $R_5$, $R_6$ and $R_7$ are independently selected from the group consisting of H, $C_{1-12}$ alkyl, $C_{7-18}$ aralkyl, phenyl, phenyl substituted by one or more $C_{1-12}$ alkyl groups, naphthyl and naphthyl substituted by one or more $C_{1-12}$ alkyl groups.

For example, the aryl amine is selected from compounds of the following formula;

III

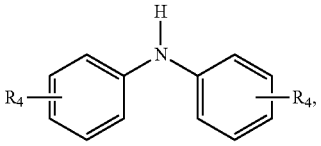

-continued

IV

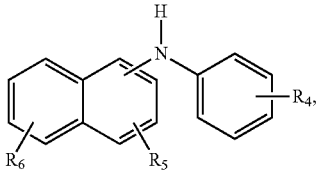

V

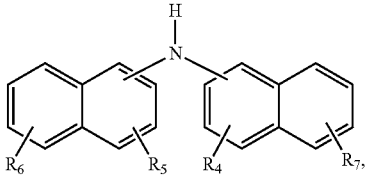

VI

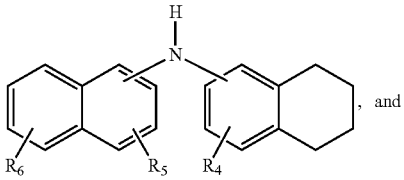

VII

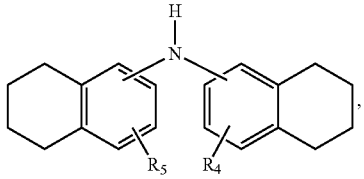

wherein $R_4$, $R_5$, $R_6$ and $R_7$ are selected as above.

Often, the diaryl amine is selected from the compounds of formula III, IV, V and VI, for example compounds of formula III, IV and V. In many embodiments the one or more diaryl amine comprises a compound of formula III, IV and V wherein $R_4$ is an alkyl group of from 4 to about 12 carbons or an aralkyl group of 8 to 10 carbons, and $R_5$, $R_6$ and $R_7$ are H.

In certain embodiments, the diaryl amine is selected from the compounds of formula IV

IV

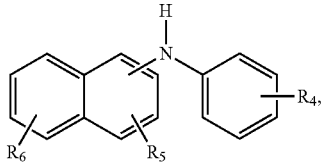

for example, compounds of formula IV wherein $R_4$ is an alkyl group of from 4 to about 12 carbons or an aralkyl group of 8 to 10 carbons, and $R_5$ and $R_6$ are H.

In many embodiments, when the group $R_4$ is present on a phenyl ring, it is in the para-position relative to the amino nitrogen, for example, a compound of formula

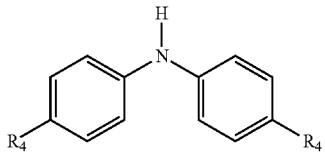

-continued

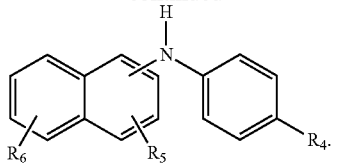

"Alkyl" or "alkyl group" refers to straight or branched chained or cyclic alkyl substitutents of the stated number of carbon atoms. $C_{1-12}$ alkyl includes, for example, methyl, linear ethyl, propyl, butyl, pentyl, hexyl, heptyl, octyl, nonyl, decyl, undecyl, dodecyl; branched propyl, butyl, pentyl, hexyl, heptyl, octyl, nonyl, decyl, undecyl, dodecyl; cyclic propyl, butyl, pentyl, hexyl, heptyl, octyl, nonyl, decyl, undecyl, dodecyl; polycyclic nonyl, decyl, undecyl, dodecyl; which cyclic moieties are substituted by alkyl groups, provided that the total number of carbon atoms comprised by the substituted cyclic group is within the identified range of carbon atoms.

"Aryl" or "aryl group" refers to an aromatic cyclic or polycyclic group, generally a carbocycle, containing the identified number of carbon atoms, for example, phenyl, naphthyl or anthracenyl.

"Aralkyl" refers to aryl group which is attached to the structure via an alkylene group wherein the number of carbon atoms of the aryl and alkylene groups combined contains the identified number of carbon atoms, for example, $C_{7-18}$ aralkyl, includes benzyl, styryl, cumyl, phenylethyl, naphthylmethyl, naphthylethyl and the like.

Examples of commercially available phenylnaphthylamine antioxidants include, NAUGALUBE APAN and NAUGARD PANA from Chemtura Corporation; and IRGANOX LO 6 from BASF. Examples of commercially available phenylenediamine antioxidants include NAUGALUBE 403, NAUGALUBE 438, NAUGALUBE 438L, NAUGALUBE 640, NAUGALUBE 635, NAUGALUBE AMS; from Chemtura Corporation; and IRGANOX L 57 from BASF.

Numerous commercially available organic radical initiators are known which might be used under various carefully selected conditions to initiate the reaction of this invention. Examples include: diisobutyryl peroxide, didecanoyl peroxide, dibenzoyl peroxide, di(3,5,5-trimethyl-hexanoyl) peroxide, dilauroyl peroxide, dicumyl peroxide, tert-butyl cumyl peroxide, di-tert-butyl peroxide; 2,5-dimethyl-2,5-di(2-ethylhexylhexanoylperoxy)hexane; 1,1-di(tert-butyl peroxy)-3,3,5-trimethylcyclohexane; 1,1-di(tert-amylperoxy)-cyclohexane; 1,1-di(tert-butyl-peroxy)-cyclohexane; 2,2-di(tert-butylperoxy)butane, di(tert-butylperoxyisopropyl) benzene(s); 2,5-dimethyl-2,5-di(tert-butylperoxy)hexane; 2,5-dimethyl-2,5-di(tert-butylperoxy)hexyne-3; 3,6,9-triethyl-3,6,9-trimethyl-1,4,7-peroxonane, tert-amyl hydroperoxide, tert-butyl hydro-peroxide, cumyl hydroperoxide, isopropylcumyl hydroperoxide; 1,1,3,3-tetramethylbutyl hydroperoxide; 3,3,5,5,7-pentamethyl-1,2,4-trioxepane, cumyl peroxyneodecanoate, tert-amyl peroxyneodecanoate, tert-butyl peroxyneodecanoate, tert-amyl peroxyacetate, tert-butyl peroxyisoburyrate, cumyl peroxyneoheptanoate, tert-butyl peroxyneoheptanoate, tert-butyl peroxydiethylacetate, tert-butyl peroxy-2-ethylhexanoate, 1,1,3,3-tetramethylbutyl peroxyneodecanoate, 1,1,3,3-tetramethylbutyl peroxypivalate, tert-amyl peroxypivalate, tert-butyl peroxypivalate, 1,1,3,3-tetramethylbutyl peroxy-2-ethylhexanoate, tert-amyl peroxy-2-ethylhexanoate, tert-butyl peroxy-3,3,5-trimethylhexanoate, tert-amyl peroxybenzoate, tert-butyl peroxybenzoate, tert-butyl peroxyacetate, butyl 4,4-di(tert-butylperoxy) valerate, di(3-methoxybutyl) peroxydicarbonate, di-sec-butyl peroxydicarbonate, diisopropyl peroxydicarbonate, di(4-tert-butylcyclohexyl) peroxydicarbonate, di(2-ethylhexyl) peroxydicarbonate, dibutyl peroxydicarbonate, diacetyl peroxydicarbonate, dimyristyl peroxydicarbonate, tert-amylperoxy 2-ethylhexyl carbonate, tert-butylperoxy isopropyl carbonate, tert-butylperoxy 2-ethylhexyl carbonate.

The use of organic initiators containing an azo group is also well known in the art. Commercially available examples include: 2,2'-azobis(isobutyronitrile), "AIBN"; 2,2'-azobis (2-methylbutyronitrile); 1,1'-azobis(cyclohexanecarbonitrile); 4,4'-azobis(4-cyanopentanoic acid), 2,2'-azobis(2-methylpropionamidine) dihydrochloride.

However, THE READER IS STRONGLY CAUTIONED that many of the above initiators would be dangerous, and potentially explosive if used under the conditions set forth in the examples. Many of these initiators must be stored and used at temperatures well below room temperature, which becomes increasingly inconvenient on a commercial manufacturing scale.

Preferred initiators will yield decomposition products that are relatively non-toxic and that can be readily removed from the product mixture by distillation. For this reason peroxide type initiators are preferred over nitrile bearing azo-initiators such as 2,2'-azobis(isobutyronitrile), "AIBN"; 2,2'-azobis(2-methylbutyronitrile); 1,1'-azobis(cyclohexanecarbonitrile) and 4,4'-azobis(4-cyanopentanoic acid), which may result in toxic nitrile groups becoming incorporated into the product. The highly toxic compound tetramethylsuccinonitrile is a known by-product of AIBN decomposition (DuPont trade literature).

Common sense, safety concerns, and the American Chemistry Council principles of Responsible Care® all indicate the selection of the least hazardous initiator that is sufficient to conduct the reaction. Two widely used indicators of organic initiator reactivity are the reaction half-life t½ (the time required for half of the material to decompose at a given temperature), and the SADT (Self-Accelerating Decomposition Temperature). This data is available from most manufacturers of initiators. For the convenience of the potential user, half-life data for initiators is often provided as the temperature at which 50% of the material will decompose within a given time, such as 0.1 h, 1.0 h, or 10 h.

Typically, reactions to form the antioxidant of the invention are run at a temperature such that t½ is about 1 h. For reasons of safety and convenience, it is preferred that the initiator has a SADT of about 60° C. or higher, and t½=1.0 h at about 110° C. or higher. Most initiators that meet these requirements can be stored at or above room temperature.

Another indicator of the relative hazard of a potentially unstable material, such as an initiator, is it's classification by the United Nations Committee of Experts on the Transportation of Hazardous Goods (UN Number). The UN Number dictates the maximum container size that can be used to transport a given material. It is more preferred that the initiator has one of the following UN Numbers: 3107, 3109, 3110, 3117, 3119, 3120. Materials given one of these classifications can be shipped in containers of 400 kg or larger.

Examples of initiators which meet the above criteria of t½, SADT and UN Number are di-cumyl peroxide, tert-butyl cumyl peroxide, and di-tert-butyl peroxide.

For ease of handling, the initiator is often a liquid; and for ease of processing, available in neat form without significant amounts of diluents, such as mineral oil or petroleum distillates. For many applications certain diluents would have to be removed from the final product, as they may degrade the performance of the lubricant in areas such as volatility, deposits, flash point, and viscosity. An initiator fulfilling all these criteria is, for example, di-tert-butyl peroxide.

In many embodiments, the antioxidant is formed from the radical initiated reaction, typically a peroxide initiated reaction, of at least one diphenylamine of formula I and at least one diarylamine of formula II in the presence of a diluent ester fluid, for example, a polyol ester lubricant. In such cases, the ester often becomes a participant in the reaction becoming part of one or more antioxidant cross products. Reaction can occur at more one site of the ester, particularly when a polyol ester with more than one favorable site for radical formation.

Concentrates of the antioxidant in a fluid such as a polyol ester can also be directly formed in such a reaction by not removing the diluent, or removing only a portion of the diluent. This is advantageous in that once, e.g., a polyol ester reacts with one of the amines, the product forms contributes to the overall antioxidant activity. Is also possible to add a diluent or carrier compatible with the end use composition to an already prepared antioxidant of the invention to form a concentrate.

Whether the antioxidant is, e.g., in the from of a concentrate, or the neat product mixture of the reaction of diphenylamine and diarylamine alone, the amines of said product mixture are at least 20% by weight of the antioxidant. For example the amines of the product mixture are present in the antioxidant at 20 to 100% by weight based on the total weight of the antioxidant composition, for example, the amines of the product mixture at least 25%, 30%, 35%, 40%, 60% 70% or at least 80% by weight and in some embodiment the antioxidant consists essentially of the amines of the product mixture.

Peroxides are known to form in lubricant compositions and lubricants stabilized by adding phenylenediamines and diarylamines may also contain organic peroxides which theoretically could form the inventive cross products. However antioxidants are useful in keeping peroxides at a low level and the probability of an effective amount of the inventive cross products forming, especially in a timely manner to prevent oxidation, is extremely small and has not been previously reported. Further, the formation of the inventive cross products is not likely in light of the present data showing superior performance for formulations prepared using the inventive cross products relative to formulations prepared with the parent phenylene diamines and diaryl amines added as separate compounds.

The antioxidant of the invention is not to be confused with any negligible amounts of products which may surreptitiously form during high temperature use of a lubricant formulation containing phenylene diamine and diaryl amine, but rather is the product mixture formed by adding a molar excess of an organic initiator such as an organic peroxide to a mixture of phenylenediamine and diarylamine at a temperature which causes the decomposition of the initiator.

For example, the antioxidant of the invention is conveniently prepared by adding gradually or in portions, generally under a nitrogen atmosphere, a molar excess of organic peroxide to a heated mixture of the phenylenediamine and diarylamine, e.g., a 10:1 to 1:10 molar ratio of phenylenediamine:diarylamine, and optionally a solvent or carrier. Decomposition of the organic peroxide during reaction produces an alcohol byproduct, for example di-tert-butyl peroxide generates tert-butanol which is removed by distillation over the course of the reaction.

A molar excess of initiator, e.g., a molar excess of peroxide, is an amount of peroxide which exceeds the amount required to form one mole of radical species for the combined molar quantity of amine. For example a reaction of 1 mole of diphenylamine with 1 mole of diarylamine would require 2 moles of radical species which can be provided by 1 mole of di-tert-butyl peroxide, as 2 moles of alkoxy radicals can be generated per mole of peroxide. Thus, an excess of one mole of di-tert-butyl peroxide is used in the reaction. Better results are obtained when the molar excess of peroxide is appreciably higher, for example, at least a two fold excess, at least a three fold excess, or a four fold or higher excess. For example, the reaction to form the inventive antioxidant will use 1.1 to 20 molar equivalents of radical producing species per mole of total amine, in some embodiments 1.1 to 10 molar equivalents, often 2 to 10 or 2 to 6 molar equivalents.

The molar ratio of phenylenediamine:diarylamine can be anywhere from 10:1 to 1:10, for example 5:1 to 1:5, 3:1 to 1:1, 1:2 to 2:1. In certain embodiments the molar ratio is about 2:1, 1.5:1, 1:1, 1:1.5, or 1:2.

In one example, an antioxidant of the invention is prepared by heating a mixture of 29.8 g (N-phenyl-N'-1,4-dimethylpentyl)-p-phenylenediamine, 40.9 g dodecyl-phenyl-α-naphthylamine, and 131.3 Hatcol® 1189 pentaerythritol ester lubricant to approximately 145° C. and adding thereto 44.0 g of di-tert-butyl peroxide over 5 hours via an addition funnel. After about half of the peroxide is added tert-butanol begins to distill through a distillation column and is collected. Once the addition is complete, the reaction temperature is increased to 173° C. over 1h. The reaction is cooled, the distillation column is replaced by a short-path condenser and volatiles are distilled under vacuum to an internal pot temperature of 173° C. at 0.15 torr. The reaction mixture is pressure filtered hot through a 1μ filter pad, yielding 195.6 g of brown liquid.

The temperature of the reaction mixture should be at least at or near the decomposition temperature of the peroxide being used. This will vary according to the selected peroxide and may also vary depending on whether a material promoting peroxide decomposition in a manner which would lower the temperature is employed. Selecting the temperature range for the reaction is well within the skill of the typical practitioner.

In any reaction preparing the present antioxidants, more than one phenylenediamine, diarylamine, initiator or carrier/diluent may be employed.

The antioxidant can be blended with other components typically encountered in whatever end use application is envisioned. For example, polymeric compositions such as rubber or lubrication fluids typically contain other antioxidants, compatibilizers, anti wear agents, flame retarders, other stabilizers and performance enhancing additives.

The compounds of the present invention improve the oxidative stability of organic materials, which are subject to oxidative, thermal, and/or light-induced degradation and can be incorporated in a variety products. These organic materials can be natural or synthetic. These organic materials can include "functional fluids," lubricating oils, greases, and fuels, as well as automatic and manual transmission fluids, power steering fluid, hydraulic fluids, engine oils, marine cylinder oils, gas turbine oils, aviation turbine oils, compressor lubricants, refrigeration lubricants, automotive and industrial gear lubricants, and heat transfer oils. The antioxidant of the invention is well suited for use in relatively polar fluids, such as synthetic esters, polyol ethers, polyalkylene glycols, phosphate esters, and the like.

Lubricating oil compositions useful in the practice of the present invention comprise a major amount of oil of lubricating viscosity and a minor amount of at least one cross-oligomer of a phenylene diamine and a diarylamine to improve oxidative stability, and/or inhibit degradation or deposit formation of lubricants.

Esters useful as synthetic oils are well known and include those made from $C_5$ to $C_{12}$ monocarboxylic acids and polyols and polyol esters such as neopentyl glycol, trimethylolpropane, pentaerythritol, dipentaerythritol and tripentaerythritol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2 ethylhexanoic acid.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide and the alkyl and aryl ethers of polyoxyalkylene polymers (e.g., methylpolyisopropylene glycol ether having a molecular weight of 1000 or diphenyl ether of polyethylene glycol having a molecular weight of 1000 to 1500), and mono- and polycarboxylic esters thereof, for example, the acetic acid esters, mixed $C_3$-$C_8$ fatty acid esters, and $C_{13}$ oxo acid diester of tetraethylene glycol.

Useful examples of alkyl esters of fatty acids can include commercial mixtures of the ethyl, propyl, butyl and methyl esters of fatty acids with 12 to 22 carbon atoms, for example, lauric acid, myristic acid, palmitic acid, palmitoleic acid, stearic acid, oleic acid, elaidic acid, petroselic acid, ricinoleic acid, elaeostearic acid, linoleic acid, linolenic acid, eicosanoic acid, gadoleic acid, docosanoic acid, or erucic acid. For example, mixtures which contain mainly, i.e., at least 50 wt. %, methyl esters of fatty acids with 16 to 22 carbon atoms and 1, 2, or 3 double bonds, such as oleic acid, linoleic acid, linolenic acid, and erucic acid have excellent properties.

Natural oils include animal oils and vegetable oils (e.g., lard oil, castor oil); liquid petroleum oils and hydrorefined, solvent-treated or acid-treated mineral oils of the paraffinic, naphthenic, and mixed paraffinic-naphthenic types. Oils of lubricating viscosity derived from coal or shale also serve as useful base oils. Other examples of oils and fats derived from animal or vegetable material are rapeseed oil, coriander oil, soya bean oil, cottonseed oil, sunflower oil, castor oil, olive oil, peanut oil, maize oil, almond oil, palm kernel oil, coconut oil, mustard seed oil, jatropha oil, beef tallow, and fish oils. Further examples include oils derived from corn, jute, sesame, shea nut, ground nut, and linseed oil, and may be derived therefrom by methods known in the art. Rapeseed oil, which is a mixture of fatty acids partially esterified with glycerol, is available in large quantities and can be obtained in a simple way by pressing from rapeseed. Recycled oils such as used kitchen oils are also suitable.

Oils of lubricating viscosity useful in the context of the present invention can also be selected from natural lubricating oils, synthetic lubricating oils, and mixtures thereof. The lubricating oil can range in viscosity from light distillate mineral oils to heavy lubricating oils, such as gasoline engine oils, mineral lubricating oils, and heavy duty diesel oils. Generally, the viscosity of the oil ranges from about 2 centistokes to about 40 centistokes, especially from about 4 centistokes to about 20 centistokes, as measured at 100° C.

Certain oils and naturally occurring fats useful as lubricants have also found use as fuel, including so-call biofuels and biodiesels. Biofuels are often combined with petroleum-based fuel oil, especially a middle distillate fuel oil. The present antioxidants also have value in stabilizing fuels and the lubricants that may be present during the use of such fuels.

Synthetic lubricating oils also include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1 octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulfides and derivative, analogs, and homologs thereof. Also useful are synthetic oils derived from a gas to liquid process from Fischer-Tropsch synthesized hydrocarbons, which are commonly referred to as gas to liquid or "GTL" base oils.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl) silicate, tetra-(4-methyl-2-ethylhexyl)silicate, tetra-(p-tert-butyl-phenyl) silicate, hexa-(4-methyl-2-ethylhexyl)disiloxane, poly(methyl)-siloxanes and poly(methylphenyl) siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

The oil of lubricating viscosity can comprise a Group I, Group II, or Group III base stock or base oil blends of the aforementioned base stocks. For example, the oil of lubricating viscosity is a Group II or Group III base stock, or a mixture thereof, or a mixture of a Group I base stock and one or more of a Group II and Group III. A major amount of the oil of lubricating viscosity may be a Group II, Group III, Group IV, or Group V base stock, or a mixture thereof. The base stock, or base stock blend, typically has a saturate content of at least 65%, more preferably at least 75%, such as at least 85%, and in often a saturate content of greater than 90%. Oil or oil blend having a sulfur content of less than 1%, e.g., less than 0.6%, or less than 0.4%, by weight are known to have various advantages.

Generally the volatility of the oil or oil blend, as measured by the Noack volatility test (ASTM D5880), is less than or equal to 30%, less than or equal to 25%, less than or equal to 20%, and may be less than or equal to 16%. The viscosity index (VI) of the oil or oil blend is not particularly limited but in many applications is at least 85, preferably at least 100, most preferably from about 105 to 140. Definitions for the base stocks and base oils in this invention are well known in the field and are the same as those found in the American Petroleum Institute (API) publication "Engine Oil Licensing and Certification System," Industry Services Department (14th ed., December 1996), Addendum 1, December 1998.

Additional additives may be incorporated in the compositions of the invention to enable them to meet particular requirements. Examples of additives that may be included in the lubricating oil compositions are dispersants, detergents, metal rust inhibitors, viscosity index improvers, corrosion inhibitors, oxidation inhibitors, friction modifiers, other dispersants, anti-foaming agents, anti-wear agents and pour point depressants. Some are discussed in further detail below. Lubricating oil compositions of the present invention can further contain one or more ashless dispersants, which effectively reduce formation of deposits upon use in gasoline and diesel engines, when added to lubricating oils. Ashless dispersants useful in the compositions of the present invention comprise an oil soluble polymeric long chain backbone having functional groups capable of associating with particles to be dispersed. Typically, such dispersants comprise amine, alcohol, amide or ester polar moieties attached to the polymer backbone, often via a bridging group. The ashless dispersant can be, for example, selected from oil soluble salts, esters, amino-esters, amides, imides, and oxazolines of long chain hydrocarbon-substituted mono- and polycarboxylic acids or anhydrides thereof; thiocarboxylate derivatives of long chain hydrocarbons; long chain aliphatic hydrocarbons having polyamine moieties attached directly thereto; and Mannich condensation products formed by condensing a long chain substituted phenol with formaldehyde and polyalkylene polyamine.

Common dispersants include polyamine-derivatized poly alpha-olefin, dispersants, particularly ethylene/butene alpha-olefin and polyisobutylene-based dispersants. Particularly preferred are ashless dispersants derived from polyisobutylene substituted with succinic anhydride groups and reacted with polyethylene amines, e.g., polyisobutylene succinimide, polyethylene diamine, tetraethylene pentamine; or a polyoxyalkylene polyamine, e.g., polyoxypropylene diamine, trimethylolaminomethane; a hydroxy compound, e.g., pentaerythritol; and combinations thereof. For example, one well known dispersant combination is a combination of (A) polyisobutylene substituted with succinic anhydride groups and reacted with (B) a hydroxy compound, e.g., pentaerythritol; (C) a polyoxyalkylene polyamine, e.g., polyoxypropylene diamine, or (D) a polyalkylene diamine, e.g., polyethylene diamine and tetraethylene pentamine using about 0.3 to about 2 moles of (B), (C) and/or (D) per mole of (A). Another combination comprises a combination of (A) polyisobutenyl succinic anhydride with (B) a polyalkylene polyamine, e.g., tetraethylene pentamine, and (C) a polyhydric alcohol or polyhydroxy-substituted aliphatic primary amine, e.g., pentaerythritol or trismethylolaminomethane.

Another class of ashless dispersants comprises Mannich base condensation products such as those prepared by condensing about one mole of an alkyl-substituted mono- or polyhydroxy benzene with about 1 to 2.5 moles of carbonyl compound(s) (e.g., formaldehyde and paraformaldehyde) and about 0.5 to 2 moles of polyalkylene polyamine, as disclosed, for example, in U.S. Pat. No. 3,442,808.

The dispersant can be further post treated by a variety of conventional post treatments such as boration, as generally taught in U.S. Pat. Nos. 3,087,936 and 3,254,025. Useful dispersants often contain from about 0.05 to about 2.0 wt. %, e.g., from about 0.05 to about 0.7 wt. % boron.

The dispersant can also be further post treated by reaction with a so-called "capping agent." Conventionally, nitrogen-containing dispersants have been "capped" to reduce the adverse effect such dispersants have on the fluoroelastomer engine seals. Numerous capping agents and methods are known. Of the known "capping agents," those that convert basic dispersant amino groups to non-basic moieties (e.g., amido or imido groups) are most suitable. A variety of methods for capping nitrogen-containing dispersants are known to those skilled in the art.

Nitrogen-containing dispersants are often added in an amount providing the lubricating oil composition with from about 0.03 wt. % to about 0.15 wt. %, e.g., from about 0.07 to about 0.12 wt. %, of nitrogen.

Metal-containing or ash-forming detergents function both as detergents to reduce or remove deposits and as acid neutralizers or rust inhibitors, thereby reducing wear and corrosion and extending engine life. Detergents generally comprise a polar head with a long hydrophobic tail, with the polar head comprising a metal salt of an acidic organic compound. The salts can contain a substantially stoichiometric amount of the metal, in which case they are usually described as normal or neutral salts, and would typically have a total base number or TBN (as can be measured by ASTM D2896) of from 0 to 80. A large amount of a metal base can be incorporated by reacting excess metal compound (e.g., an oxide or hydroxide) with an acidic gas (e.g., carbon dioxide). The resulting overbased detergent comprises neutralized detergent as the outer layer of a metal base (e.g. carbonate) micelle. Such overbased detergents can have a TBN of 150 or greater and typically will have a TBN of from 250 to 450 or more.

Detergents that can be used include oil-soluble neutral and overbased sulfonates, phenates, sulfurized phenates, thiophosphonates, salicylates, naphthenates, and other oil-soluble carboxylates of a metal, particularly the alkali or alkaline earth metals, e.g., sodium, potassium, lithium, calcium, and magnesium. The most commonly used metals are calcium and magnesium, which can both be present in detergents used in a lubricant, and mixtures of calcium and/or magnesium with sodium. Particularly convenient metal detergents are neutral and overbased calcium sulfonates having TBN of from 20 to 450 TBN, and neutral and overbased calcium phenates and sulfurized phenates having TBN of from 50 to 450. Combinations of detergents, whether overbased or neutral or both, can be used.

Oil soluble sulfonates or alkaryl sulfonic acids can be neutralized with oxides, hydroxides, alkoxides, carbonates, carboxylate, sulfides, hydrosulfides, nitrates, borates, and ethers of the metal. The amount of metal compound is chosen having regard to the desired TBN of the final product but typically ranges from about 100 to 220 wt. % (preferably at least 125 wt. %) of that stoichiometrically required.

Metal salts of phenols and sulfurized phenols are prepared by reaction with an appropriate metal compound such as an oxide or hydroxide, and neutral or overbased products can be obtained by methods well known in the art. Sulfurized phenols can be prepared by reacting a phenol with sulfur or a sulfur containing compound such as hydrogen sulfide, sulfur monohalide, or sulfur dihalide, to form products which are generally mixtures of compounds in which two or more phenols are bridged by sulfur containing bridges.

Dihydrocarbyl dithiophosphate metal salts are frequently used as antiwear and antioxidant agents. The metal can be an alkali or alkaline earth metal, or aluminum, lead, tin, molybdenum, manganese, nickel or copper. The zinc salts are most commonly used in lubricating oil in amounts of 0.1 to 10 wt. %, preferably 0.2 to 2 wt. %, based upon the total weight of the lubricating oil composition. Commercial additives frequently contain an excess of zinc due to the use of an excess of the basic zinc compound in the neutralization reaction.

Examples of such antiwear additives commercially available from the Lubrizol Corp. include LUBRIZOL 677A, LUBRIZOL 1095, LUBRIZOL 1097, LUBRIZOL 1360, LUBRIZOL 1395, LUBRIZOL 5139, and LUBRIZOL 5604, among others; and from BASF: IRGALUBE 353. Oxidation inhibitors or antioxidants reduce the tendency of mineral oils to deteriorate in service. Oxidative deterioration can be evidenced by sludge in the lubricant, varnish-like deposits on the metal surfaces, and by viscosity growth. Such oxidation inhibitors include hindered phenols, alkaline earth metal salts of alkylphenolthioesters having e.g., $C_5$ to $C_{12}$ alkyl side chains, calcium nonylphenol sulfide, oil soluble phenates and sulfurized phenates, phosphosulfurized or sulfurized hydrocarbons, phosphorous esters, metal thiocarbamates, oil soluble copper compounds as described in U.S. Pat. No. 4,867,890, and molybdenum-containing compounds. Other aminic antioxidants, including phenylene diamines, diarylamines, hydroxylamines, nitroxyl compounds etc can be used along with the cross products of the inventive antioxidant.

Multiple antioxidants are commonly employed in combination. The following are exemplary of secondary diphenylamine antioxidants and are commercially available from Chemtura Corporation: NAUGALUBE 438, NAUGALUBE 438L, NAUGALUBE 640, NAUGALUBE 635, NAUGALUBE 680, NAUGALUBE AMS, NAUGALUBE APAN, NAUGALUBE PANA, NAUGALUBE 403, NAUGALUBE 410, and NAUGALUBE 420; and from BASF: IRGANOX L 06 and IRGANOX L 57. The following are exemplary of substituted phenol antioxidants commercially available from Chemtura Corporation: NAUGARD BHT, Antioxidant 431, and NAUGALUBE 531; and from BASF: IRGANOX L 115, IRGANOX L 118, IRGANOX L 135, and IRGALUBE 10A.

Friction modifiers and fuel economy agents may also be present in the present lubricant compositions, such as glyceryl monoesters of higher fatty acids, for example, glyceryl mono-oleate; esters of long chain polycarboxylic acids with diols, for example, the butane diol ester of a dimerized unsaturated fatty acid; oxazoline compounds; and alkoxylated alkyl-substituted mono-amines, diamines and alkyl ether amines, for example, ethoxylated tallow amine and ethoxylated tallow ether amine.

Other known friction modifiers comprise oil-soluble organo-molybdenum compounds. Such organo-molybdenum friction modifiers also provide antioxidant and antiwear credits to a lubricating oil composition. Examples of such oil soluble organo-molybdenum compounds include dithiocarbamates, dithiophosphates, dithiophosphinates, xanthates, thioxanthates, sulfides, and the like, and mixtures thereof. Among the molybdenum compounds useful in the compositions of this invention are organo-molybdenum compounds of the formula: $Mo(ROCS_2)_4$ and $Mo(RSCS_2)_4$, wherein R is an organo group selected from the group consisting of alkyl, aryl, aralkyl, and alkoxyalkyl, generally of from 1 to 30 carbon atoms.

Acidic molybdenum compound, for example hexavalent molybdenum compounds, which may be used include molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds.

Another group of organo-molybdenum compounds useful in the lubricating compositions of this invention are trinuclear molybdenum compounds, such as $Mo_3S_kL_nQ_z$ and mixtures thereof wherein the L are independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values.

Examples of molybdenum friction modifier additives commercially available from R. T. Vanderbilt Company, Inc. include: MOLYVAN A, MOLYVAN L, MOLYVAN 807, MOLYVAN 856B, MOLYVAN 822, MOLYVAN 855, among others. Examples commercially available from Asahi Denka Kogyo K.K. include: SAKURA-LUBE 100, SAKURA-LUBE 165, SAKURA-LUBE 300, SAKURA-LUBE 310G, SAKURA-LUBE 321, SAKURA-LUBE 474, SAKURA-LUBE 600, SAKURA-LUBE 700, among others. Examples of such friction modifier additives commercially available from Akzo Nobel Chemicals GmbH: KETJEN-OX 77M, KETJEN-OX 77TS, among others. NAUGALUBE MOLY-FM is also exemplary of such additives and is commercially available from Chemtura Corporation.

Examples of viscosity modifiers are polyisobutylene, copolymers of ethylene and propylene, polymethacrylates, methacrylate copolymers, copolymers of an unsaturated dicarboxylic acid and a vinyl compound, interpolymers of styrene and acrylic esters, and partially hydrogenated copolymers of styrene/isoprene, styrenelbutadiene, and isoprene/butadiene, as well as the partially hydrogenated homopolymers of butadiene and isoprene.

A viscosity index improver dispersant functions both as a viscosity index improver and as a dispersant. Examples of viscosity index improver dispersants include reaction products of amines, for example, polyamines, with a hydrocarbyl-substituted mono- or dicarboxylic acid in which the hydrocarbyl substituent comprises a chain of sufficient length to impart viscosity index improving properties to the compounds. In general, the viscosity index improver dispersant can be, for example, a polymer of a $C_4$ to $C_{24}$ unsaturated ester of vinyl alcohol or a $C_3$ to $C_{10}$ unsaturated mono-carboxylic acid or a $C_4$ to $C_{10}$ dicarboxylic acid with an unsaturated nitrogen-containing monomer having 4 to 20 carbon atoms; a polymer of a $C_2$ to $C_{20}$ olefin with an unsaturated $C_3$ to $C_{10}$ mono- or dicarboxylic acid neutralized with an amine, hydroxyamine or an alcohol; or a polymer of ethylene with a $C_3$ to $C_{20}$ olefin further reacted either by grafting a $C_4$ to $C_{20}$ unsaturated nitrogen-containing monomer thereon or by grafting an unsaturated acid onto the polymer backbone and then reacting carboxylic acid groups of the grafted acid with an amine, hydroxy amine, or alcohol.

Pour point depressants, otherwise known as lube oil flow improvers (LOFI), lower the minimum temperature at which the fluid will flow or can be poured. Such additives are well known. Typical of those additives that improve the low temperature fluidity of the fluid are $C_8$ to $C_{18}$ dialkyl fumarate/vinyl acetate copolymers, and polymethacrylates. Foam control can be provided by an antifoamant of the polysiloxane type, for example, silicone oil or polydimethyl siloxane. An example of a pour point depressant is polymethacrylate, and the like.

Some of the above-mentioned additives can provide a multiplicity of effects; thus, for example, a single additive can act as a dispersant-oxidation inhibitor. This approach is well known and need not be further elaborated herein.

Corrosion inhibitors include amine complexes, benzotriazole-, tolyltriazole-, thidiazole-, and imidazole-based compounds, and the like, e.g., K-CORR™100A2 from King Industries, Inc.

Viscosity index (V.I.) improvers include olefin copolymers, dispersant olefin copolymers, ethylene-α-olefin copolymers or the hydrides thereof, polyisobutylenes or the hydrides thereof, styrene-diene hydrogenated copolymers, styrene-maleate anhydride copolymers, and polyalkylstyrenes, and the like.

Anti-foamants include polysiloxane, silicones such as dimethylsilicone and fluorosilicone, and the like, such as FOAM BAN MS-575 available from Munzing/Ultra Additives.

In the present invention it may be necessary to include an additive that maintains the stability of the viscosity of the blend. Thus, although polar group-containing additives achieve a suitably low viscosity in the pre-blending stage, it has been observed that some compositions increase in viscosity when stored for prolonged periods. Additives which are effective in controlling this viscosity increase include the long chain hydrocarbons functionalized by reaction with mono- or dicarboxylic acids or anhydrides which are used in the preparation of the ashless dispersants as hereinbefore disclosed.

When lubricating compositions contain one or more of the above-mentioned additives, each additive is typically blended into the base oil in an amount that enables the additive to provide its desired function. Representative effect amounts of such additives, when used in crankcase lubricants, are listed below. All the values listed are stated as weight percent active ingredient. "Antioxidant" in the table below refers to the total amount of antioxidant, i.e., the inventive antioxidant plus any additional antioxidants, e.g., phenolic antioxidants.

TABLE

| ADDITIVE | Wt % (Desirable) | Wt % (Preferred) |
|---|---|---|
| Overbased Detergents | 0.1-15 | 0.2-9 |
| Corrosion Inhibitor | 0.0-5 | 0.0-1.5 |
| Anti-wear agents | 0.1-6 | 0.1-4 |
| Dispersants | 0.1-10 | 0.1-5 |
| Antioxidant | 0.0-5 | 0.01-3 |
| Pour Point Depressant | 0.0-5 | 0.01-1.5 |
| Antifoaming Agent | 0.0-5 | 0.001-0.15 |
| Friction Modifier | 0.0-5 | 0.0-1.5 |
| Viscosity Index Improver | 0.01-10 | 0.25-3 |
| Base stock | Balance (i.e. ~60-99.99) | Balance (i.e. ~80 to 99.99) |

Fully formulated passenger car diesel engine lubricating oil (PCDO) compositions of the present invention preferably have a sulfur content of less than about 0.4 wt. %, such as less than about 0.35 wt. %, more preferably less than about 0.03 wt. %, such as less than about 0.15 wt. %. Preferably, the Noack volatility of the fully formulated PCDO (oil of lubricating viscosity plus all additives) will be no greater than 13, such as no greater than 12, preferably no greater than 10. Fully formulated PCDOs of the present invention preferably have no greater than 1200 ppm of phosphorus, such as no greater than 1000 ppm of phosphorus, or no greater than 800 ppm of phosphorus. Fully formulated PCDOs of the present invention preferably have a sulfated ash (SASH) content of about 1.0 wt. % or less.

Fully formulated heavy duty diesel engine (HDD) lubricating oil compositions of the present invention preferably have a sulfur content of less than about 1.0 wt. %, such as less than about 0.6 wt. %, more preferably less than about 0.4 wt. %, such as less than about 0.15 wt. %. Preferably, the Noack volatility of the fully formulated HDD lubricating oil composition (oil of lubricating viscosity plus all additives) will be no greater than 20, such as no greater than 15, preferably no greater than 12. Fully formulated HDD lubricating oil compositions of the present invention preferably have no greater than 1600 ppm of phosphorus, such as no greater than 1400 ppm of phosphorus, or no greater than 1200 ppm of phosphorus. Fully formulated HDD lubricating oil compositions of the present invention preferably have a sulfated ash (SASH) content of about 1.0 wt. % or less.

It may be desirable, although not essential, to prepare one or more additive concentrates comprising additives (concentrates sometimes being referred to as additive packages) whereby several additives can be added simultaneously to the oil to form the lubricating oil composition. A concentrate for the preparation of a lubricating oil composition of the present invention can, for example, contain from about 0.1 to about 16 wt. % of alkylated-1,3-benzenediamine of the present invention; about 10 to about 40 wt. % of a nitrogen-containing dispersant; about 2 to about 20 wt. % of an aminic antioxidant and/or a phenolic antioxidant, a molybdenum compound, or a mixture thereof; about 5 to 40 wt. % of a detergent; and from about 2 to about 20 wt. % of a metal dihydrocarbyl dithiophosphate.

The final composition can employ from 5 to 25 wt. %, preferably 5 to 18 wt. %, typically 10 to 15 wt. %, of the concentrate, the remainder being oil of lubricating viscosity and viscosity modifier.

All weight percents herein (unless otherwise indicated) are based on active ingredient (A.I.) content of the additive, and/or upon the total weight of any additive-package, or formulation which will be the sum of the A.I. weight of each additive plus the weight of total oil or diluent.

The invention provides lubricating oil compositions obtained by preparing the inventive antioxidant as described above and then adding the antioxidant composition to a lubricating base stock or lubricant formulation. In one embodiment, a lubricant formulation is provided comprising about 0.1 to about 3% wt. %, e.g. 0.1 to about 1.2 wt %, of an aminic antioxidant containing the inventive antioxidant, and from about 0.1 to about 3 wt. % of phenolic antioxidant. In another embodiment, a lubricating oil composition further comprising about 10 to about 1000 ppm of a molybdenum. Another embodiment incorporates one or more of the other additives discussed above.

Often, lubricating oil compositions useful in the practice of the present invention, particularly lubricating oil compositions useful in the practice of the present invention that are required to contain no greater than 1200 ppm of phosphorus, contain additional ashless antioxidants other than those of the invention, in an amount of from about 0.1 to about 5 wt. %, e.g., from about 0.3 wt. % to about 4 wt. %, e.g., from about 0.5 wt % to about 3 wt. %. Where the phosphorus content is required to be lower, the amount of additional ashless antioxidant will increase accordingly.

EXAMPLES

Example 1

To a 500 mL 14/20 three-neck flask equipped with a magnetic stir bar; a short-path condenser with nitrogen inlet, placed atop at Vigreux column; a thermocouple, and an addition funnel is charged 29.80 g (N-phenyl-N'-1,4-dimethylpentyl)-p-phenylenediamine, 40.90 g dodecyl-phenyl-α-naphthylamine, and 131.3 Hatcol® 1189 pentaerythritol ester lubricant. The addition funnel is charged with 44.0 g di-tert-butyl peroxide.

The mixture of amines and lubricant is heated to 144° C., and the peroxide is added over 5 h. Tert-butanol begins to distill once about half of the peroxide has been added. Once the addition is complete, the reaction temperature is increased to 173° C. over 1 h. The reaction is cooled, and the Vigreux column removed, attaching the short-path condenser directly to the reaction vessel. Volatiles are distilled under vacuum to an internal pot temperature of 173° C. at 0.15 ton. The reaction mixture is pressure filtered hot through a 1μ filter pad, yielding 195.6 g of brown liquid.

Example 2

Prepared according to general procedure of Example 1; using 32.26 g tert-octyl phenyl-α-naphthylamine, 32.77 g N-(1-methyldecyl)-N'-phenyl-p-phenylenediamine, and 120.77 g Hatcol® 1189 pentaerythritol ester lubricant. N-(1-methyldecyl-N'-phenyl-p-phenylenediamine), was prepared by reductive alkylation of N-phenyl-p-phenylenediamine with Eastman C-11 ketone, available from Eastman Chemical Company.

Example 3

Prepared according to general procedure of Example 1, using 43.52 g tert-octyl phenyl-α-naphthylamine, 28.76 g N-N'-di-sec-butyl-p-phenylenediamine, and 120.77 g Hatcol® 1189 pentaerythritol ester lubricant. The vacuum strip removed 6.49 g unreacted N-N'-di-sec-butyl-p-phenylenediamine.

Example 4

Prepared according to general procedure of Example 1, using 28.72 g tert-octyl phenyl-α-naphthylamine, 24.67 N,N'-dicyclohexyl-p-phenylenediamine, and 99.24 Hatcol® 1189 pentaerythritol ester lubricant. N,N'-dicyclohexyl-p-phenylenediamine was prepared by reductive alkylation of p-phenylenediamine with cyclohexanone.

Example 5

Prepared according to general procedure of Example 1, using 41.25 g 4-dodecylphenyl-α-naphthylamine, 28.76 g N-N'-bis(1,4-dimethylpentyl)-p-phenylenediamine, and 43.6 di-tert-butyl peroxide; but without any pentaerythritol ester. Part of the resulting mixture was pressure filtered while hot, to yield 42.05 g glassy black solid. After trituration with hot isopropanol, then two methanol rinses, the remaining 16.24 g portion yielded 5.68 g brown solid, which was crushed into a powder and tested.

Comparative Example A

Prepared according to general procedure of Example 1, using 15.56 g tert-octyl phenyl-α-naphthylamine, 24.31 g N,N,N'-tris(2-ethylhexyl)-N'-phenyl-p-phenylenediamine, and 76.01 g Hatcol® 1189 pentaerythritol ester lubricant. N,N,N'-tris(2-ethylhexyl)-N'-phenyl-p-phenylene-diamine was prepared by reductive alkylation of N-phenyl-p-phenylenediamine with 2-ethylhexanal.

Comparative Example B

To a 500 mL 14/20 three-neck flask equipped with a magnetic stir bar; a short-path condenser with nitrogen inlet placed atop at Vigreux column; a thermocouple, and an addition funnel is charged 32.62 g Naugalube® 438 dioctyl diphenylamine antioxidant, 55.25 g tert-octyl phenyl-α-naphthylamine and 125 mL decane. The addition funnel is charged with 53.5 g di-tert-butyl peroxide.

The mixture is heated to 140° C., and the peroxide is added over 2 h. Tert-butanol begins to distill once about half of the peroxide has been added. The reaction is stirred at 140° C. for 2.8 h, at which point no further material distills. The reaction temperature is increased to 170° C. over 1 h, with some additional distillation. The reaction is cooled, and the Vigreux column removed, attaching the short-path condenser directly to the reaction vessel. Volatiles are distilled under vacuum to yield 87.3 g brown glassy solid.

Comparative Example C

To a 2000 mL four-neck flask equipped with an overhead stirrer, thermocouple, and condenser with nitrogen inlet is charged 142.25 Naugalube® 438 dioctyl diphenylamine antioxidant, 120.7 g tert-octyl phenyl-α-naphthylamine, 950 mL 2-butanone and 20.0 mL water. The mixture is cooled to 1° C., and 38.26 g potassium permanganate is added with stirring in twelve portions over 140 min. The mixture is held at 1° C. for an additional 30 min. The cooling bath is removed, and the reaction is allowed to warm to room temperature over 3 h. The mixture was then stirred at room temperature overnight. A 9.8 g portion of Celite® 545 diatomaceous earth is added to the mixture. The reaction mixture is pressure filtered slowly at room temperature through a layer of the diatomaceous earth on a 1μ filter pad. Volatiles are removed by rotary evaporation to yield a dark brown glassy solid.

Panel Coker Test

This test measures the weight of deposits formed by continuously splashing an oil composition from a heated sump on to a heated aluminum panel that is kept at an angle. This slope forces the hot oil to drain down across the hot panel. Lower deposit formation is interpreted as evidence for oxidative stabilization of the formulation by the antioxidant. The tests were conducted using a Koehler K50100 test apparatus (115V) and K50100 aluminum panel according to ASTM method D-4362. The panel was heated to 315° C., and the sump temperature was 100° C. Antioxidants of examples 1-5 and Comparative Examples A-C were tested according to the method of the Panel Corker Test as described and the data is presented in the following table.

In the following tables.

N-438 is 4,4'-di-tert-octyl-diphenylamine

LO-6 is N-(4-tert-octylphenyl)-α-naphthylamine

APAN is N-(4-dodecylphenyl)-α-naphthylamine (propylenetetramers)

2804 is N-(1-methyldecyl)-N'-phenyl-p-phenylenediamine di-C6H11 is N,N'-di-cyclohexyl-p-phenylenediamine N-443 is N,N'-1,4-dimethyl pentyl-p-phenylenediamine, N-403 is N,N'-di-sec-butyl-p-phenylenediamine I3 is N-1,4-dimethylpentyl-N-phenyl-p-phenylenediamine CL-1130 is (N,N,N'-tris-2-ethylhexyl-N'-phenyl-p-phenylenediamine)

| | aDPA | PANA | PDA | ratio | Panel Coker | % active |
|---|---|---|---|---|---|---|
| Examples | | | | | | |
| 1 | | APAN | I-3 | 1:1 | 0.0524 | 35 |
| 2 | | LO-6 | 2804 | 1:1 | 0.0419 | 35 |
| 3 | | LO-6 | N-403 | 1.3:1 | 0.0349 | 31.5 |
| 4 | | LO-6 | di-C6H11 | 1:1 | 0.0252 | 35 |
| 5 | | APAN | N-443 | 1:1 | 0.0578 | 100 |
| Comparative Examples | | | | | | |
| A | | LO-6 | CL-1130 | 1:1 | 0.1137 | 34.4 |
| B | N-438 | LO-6 | | 1:2 | 0.0638 | 100 |
| C | N-438 | LO-6 | | 1:1 | 0.0448 | 100 |

Additional Examples 6-13 invention were prepared using a procedure equivalent to that according to Example 1 and tested according to the method of the Panel Corker Test as were additional Comparative Examples D-L. The amines and ratios used to prepare the samples are shown in the table; % active represents the wt % of the amines in a composition comprising the amines and HATCOL 1198. Comparative examples I, J and K are oligomeric amines prepared using only the amine shown according to a procedure equivalent to that according to Example 1; Comparative examples D-H are blends of these homo-oligomers; and comparative example L is a cross oligomer prepared analogously to comparative Example A.

| | aDPA | PANA | PDA | ratio | Panel Coker | % active |
|---|---|---|---|---|---|---|
| Examples | | | | | | |
| 6 | | LO-6 | N-443 | 1:1 | 0.044 | 35 |
| 7 | | APAN | N-403 | 1:1 | 0.0373 | 35 |
| 8 | | APAN | N-403 | 1:1 | 0.0375 | 66 |
| 9 | | APAN | N-443 | 1:1 | 0.0658 | 35 |
| 10 | | APAN | N-443 | 1:1 | 0.0355 | 69.9 |
| 11 | N-438 | | N-403 | 1:1 | 0.0594 | 35.0 |
| 12 | | LO-6 | I-3 | 1:1 | 0.0355 | 69.7 |
| 13 | | LO-6 | N-443 | 1:1 | 0.0429 | 69.8 |
| Comparative Examples | | | | | | |
| D | N-438 | LO-6 | | 1:2 | 0.0569 | 35.5 |
| E | N-438 | LO-6 | | 1:1 | 0.0706 | 34.9 |
| F | N-438 | LO-6 | | 1:2 | 0.1086 | 34.9 |
| G | N-438 | LO-6 | | 2:1 | 0.0833 | 34.9 |
| H | N-438 | APAN | | 2:1 | 0.1386 | 58.8 |
| I | | LO-6 | | | 0.0744 | 34.7 |
| J | N-438 | | | | 0.0607 | 35.0 |
| K | | APAN | | | 0.0936 | 35.0 |
| L | N-438 | | CL-1130 | 1:1 | 0.1170 | 35.0 |

What is claimed is:

1. An antioxidant comprising a mixture of cross products obtained by reacting a) at least one phenylene diamine of formula I,

I

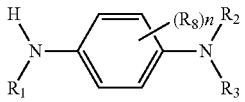

wherein $R_1$ is selected from the group consisting of $C_{1-12}$ alkyl, and $C_{7-18}$ aralkyl;

$R_2$ and $R_3$ are independently selected from the group consisting of H, $C_{1-12}$ alkyl, and $C_{7-18}$ aralkyl;

n is 0, 1 or 2 and $R_8$ is $C_{1-12}$ alkyl, wherein when n is 2, each $R_8$ may be the same or different; with b) at least one diaryl amine of formula IV or V

IV

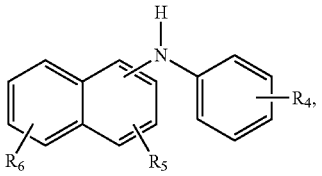

-continued

V

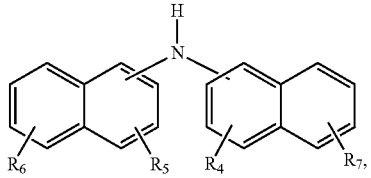

wherein each $R_4$, $R_5$, $R_6$ and $R_7$ are independently selected from the group consisting of H, $C_{1-12}$ alkyl, $C_{7-18}$ aralkyl, phenyl, phenyl substituted by one or more $C_{1-12}$ alkyl groups, in the presence of a molar excess of an initiator selected from organic peroxides and in the presence of a polyol ester.

2. The antioxidant according to claim 1 wherein n is 0.

3. The antioxidant according to claim 1 wherein a) the at least one phenylene diamine of formula I is selected from the group consisting of compounds according to

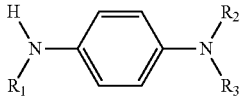

wherein $R_1$ is selected from the group consisting of $C_{1-12}$ alkyl, $C_{7-18}$ aralkyl;

$R_2$ is selected from the group consisting of $C_{1-12}$ alkyl, $C_{7-18}$ aralkyl;

$R_3$ is selected from the group consisting of H, $C_{1-12}$ alkyl, $C_{7-18}$ aralkyl; and b) the at least one diaryl amine is selected from the group consisting of compounds according to formula IV

IV

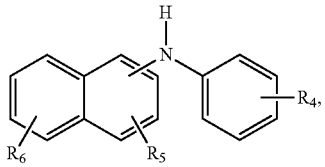

wherein each $R_4$, $R_5$, $R_6$ and $R_7$ are independently selected from the group consisting of H, $C_{1-12}$ alkyl, $C_{7-18}$ aralkyl, phenyl, phenyl substituted by one or more $C_{1-12}$ alkyl groups, naphthyl and naphthyl substituted by one or more $C_{1-12}$ alkyl groups.

4. The antioxidant according to claim 3 comprising at least one cross product obtained from a reaction wherein at least one phenylene diamine of formula I, at least one diaryl amine of formula IV, and at least one polyol ester are reacted together into the same cross product.

5. The antioxidant according to claim 4 wherein $R_1$ and $R_2$ are independently alkyl groups of from 4 to 8 carbons, $R_4$ is an alkyl group of from 4 to about 12 carbons or an aralkyl group of 8 to 10 carbons, and $R_5$ and $R_6$ are H.

6. The antioxidant according to claim 3 wherein $R_1$ and $R_2$ are independently alkyl groups of from 4 to 8 carbons, $R_4$ is an alkyl group of from 4 to about 12 carbons or an aralkyl group of 8 to 10 carbons, and $R_5$ and $R_6$ are H.

7. The antioxidant according to claim 3 in the form of a concentrate comprising the mixture of cross products and a polyol ester.

8. The antioxidant according to claim 1 comprising co-oligomers formed by the reaction of one or more compounds of formula I and one or more compounds of formula IV or V.

9. The antioxidant according to claim 1 in the form of a concentrate comprising the mixture of cross products and a polyol ester.

* * * * *